United States Patent [19]

Zuesse

[11] 4,183,583

[45] Jan. 15, 1980

[54] HEAD-SUPPORT FOR USE IN A RECLINING SEAT

[76] Inventor: Lance E. Zuesse, 28 Bedford St., New York, N.Y. 10014

[21] Appl. No.: 924,992

[22] Filed: Jul. 17, 1978

[51] Int. Cl.[2] ..... A47C 1/10; A47C 31/00

[52] U.S. Cl. ..... 297/393; 248/118; 297/464

[58] Field of Search ..... 248/118; 297/384, 385, 297/393, 391

[56] References Cited

U.S. PATENT DOCUMENTS

| | | | |
|---|---|---|---|
| 1,260,929 | 3/1918 | Maxcy | 248/118 X |
| 1,589,900 | 1/1926 | Ringborg | 297/393 |
| 2,973,030 | 2/1961 | Matthewson | 297/393 |
| 3,101,973 | 8/1963 | Toth | 297/391 |
| 3,114,527 | 12/1963 | Demarest | 248/118 |

*Primary Examiner*—James T. McCall

[57] ABSTRACT

A support for maintaining the head in an upright position while the seat-occupant is seated in a reclining seat. One part of the support is a forehead-engagement means to resist forward movement of the head. Forehead pressure against this means is transmitted by connecting means to a back-plate positioned between the back of the seat-occupant and the back-rest of the seat. With the seat-back-rest partially backward-inclined, and the forehead inclined sightly forward to rest forward against the forehead-engagement means, there is a tendency for the back-plate to rotate forward at the top and backward at the bottom. At the top, it's resisted by the seat-occupant's back, resting backward against the back-plate; at the bottom, this rotational tendency is resisted by the seat-back-rest. The back-plate, thus sandwiched between the seat-occupant and the seat, maintains the forehead-engagement means in position to resist the forward-pressure of the resting forehead, so that the forehead is prevented from falling forward and downward toward the chest; in other words, the head is thus supported.

Ancillary support means can be added to supplement the basic head-support above-described. Thus, for instance, there may be lateral-support means engaging the shoulders as part of the connecting means or back-plate, to resist lateral movement of the sleeping or resting head in the event that the seat-occupant (for example) is in transit aboard a vehicle which sways from side to side thus tossing the head left and right.

All versions of this head-support depend upon the basic principle of preventing forward-falling of the forehead by transmitting this forward pressure via the connecting means to the back-plate sandwiched between the seat-occupant's back and the seat-back-rest.

2 Claims, 6 Drawing Figures

HEAD-SUPPORT FOR USE IN A RECLINING SEAT

BACKGROUND

This invention relates to head-supports, and more particularly to a support intended for use in supporting the head for resting or sleeping in an upright position while the seat-occupant is in a partially-reclined seat (as often happens, for example, in buses, trains, planes, etc., particularly on long rides).

There presently exist many types of head supports and cervical braces for maintaining the head in a desired position, but none that depend upon the basic principle hereindescribed and elucidated, and involving the resistance of forward-falling of the forehead by utilizing the pressure of the back against the partially reclined seat-back-rest to sandwich the back-plate in a fixed position, thus likewise supporting the forehead in a fixed position.

This device is also unique in requiring for its effectiveness a reclined seat whose back-rest is an essential component of the total head-support system. The device cannot function at all without pressure (at the bottom of the back-plate) against the seat-back-rest. It is resistance of the seat-back-rest to this pressure from the back-plate, which is ultimately responsible for supporting the forehead.

SUMMARY

This device has the advantage of great simplicity in its basic principle (consequently cheapness of manufacture), and also that it can be made easily foldable, as for example by employing folding means on the back-plate or connecting means, so as to collapse the device. Also, it can easily be made adjustable for different sizes of heads, by adjustment-means between the forehead-engagement means and the connecting means. As mentioned before, it can also include lateral-support means as part of the back-plate or connecting means, to rest undue lateral forces such as one might encounter for example on a swaying bus.

DRAWINGS

DESCRIPTION OF THE PREFERRED EMBODIMENTS

Figure 1:
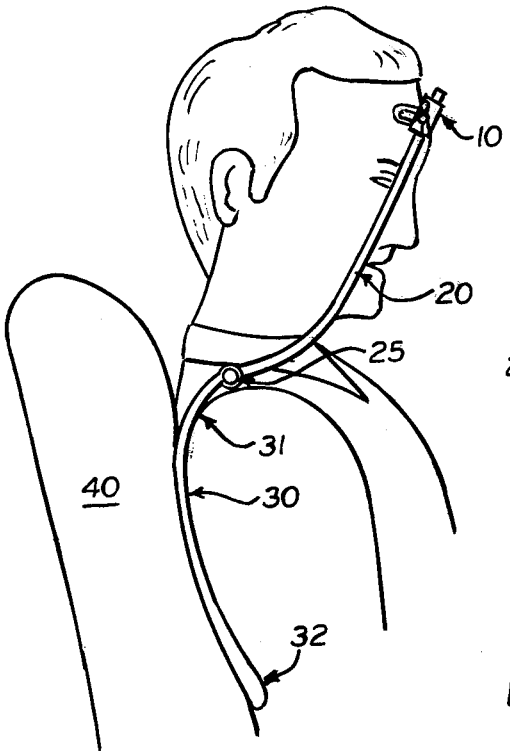
FIG. 1 is a side view of a versatile embodiment of the device in use.
Figure 2:
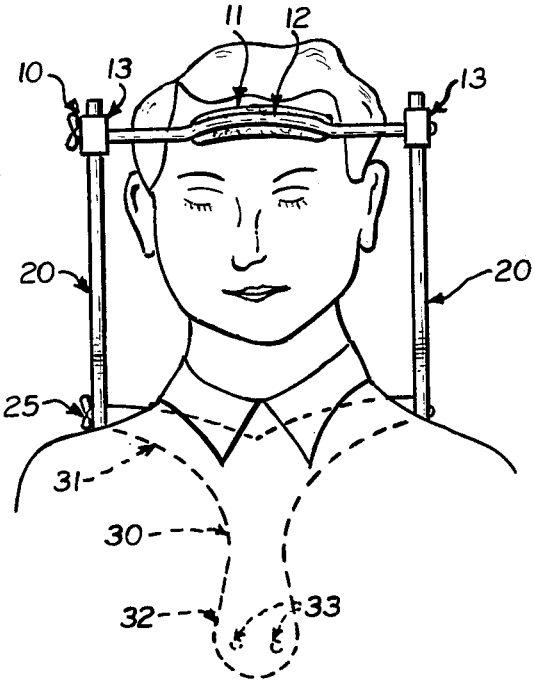
FIG. 2 is a front view thereof.
Figure 3:
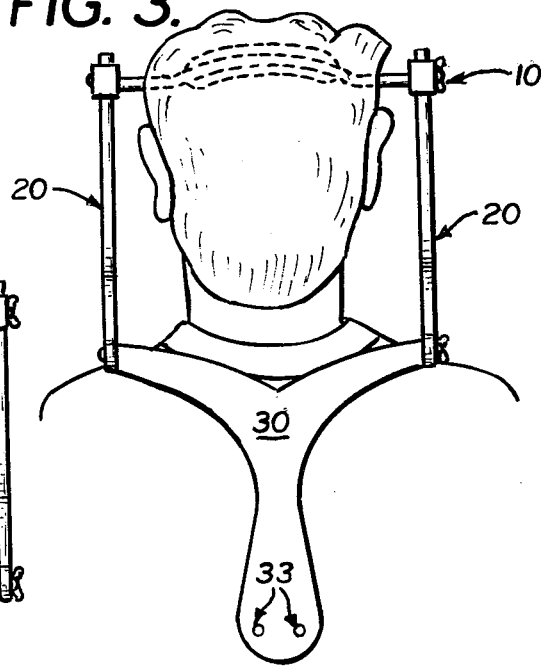
FIG. 3 is a rear view thereof.
Figure 4:
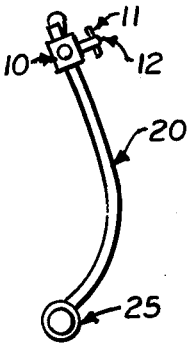
FIG. 4 is a side view of said embodiment folded.
Figure 5:
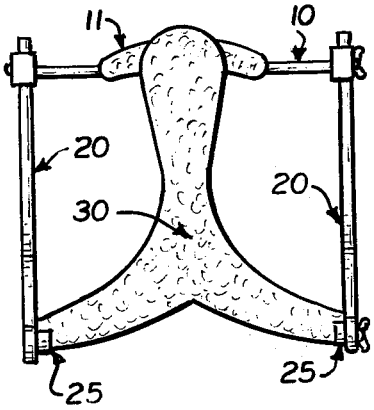
FIG. 5 is a front view of said embodiment folded.
Figure 6:
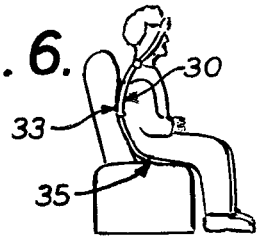
FIG. 6 is a side view of the device being used with a cloth extender to the base of the seat.

Referring now to the drawings, the invention in its fundamental concept utilizes forehead-engagement means 10, connecting means 20, and back-plate 30, in combination with seat-back-rest 40, which latter is in a partially reclined position.

There may, in some embodiments, be adjustment means 13, to adapt the device to various sizes of heads. Also, forehead-engagement means 10 may be comprised of a pad 11 attached to a bar 12.

Back-plate 30 may fold with connecting means 20 at a joint or right-and-left joints 25. Back-plate 30 may also comprise attachment-means 33 such as female snap-receptacles, for attaching such as via male snap-segments, a non-elastic cloth 35 which extends below the bottom of back-plate 30 to underneath the seat-occupant's rump, said cloth 35 to be held sandwiched between his rump and the seat-cushion, by the weight of the rump upon the cloth upon the seat-cushion, thus to add additional means to prevent back-plate 30 from rotating at its bottom 32 away from the seat-occupant's back, thereby reinforcing the effectiveness of the forehead-engagement means 10 as a stationary resisting element against forward-pressure of the seat-occupant's forehead. Such non-elastic cloth 35 would then serve to supplement the function of the seat-back-rest 40 for the basic support of the forehead, by providing another means of preventing rotation of back-plate 30 away from the back of the seat-occupant at the bottom 32 of the back-plate; it being essential to prevent said rotation in order for the head support to serve its basic function of resisting forward-pressure of the sleeping or resting forehead.

There may also be lateral-support means 31 engaging the shoulders as part of the connecting means 20 or back-plate 30, to resist lateral movement of the sleeping or resting head.

The preferred embodiment, as shown in FIGS, 1, 2, 3, and 5, possesses a back-plate 30 which is a generally curved-y-shaped member with the legs of the y-shaped plate extending upwardly over the shoulders of the seat-occupant, two connecting means 20 extend upwardly from the legs of the y-shaped (or bifurcated) plate at each side of the seat-occupant's head; and the forehead-engagement means 10 is attached to and extends transversely between the connecting means. In other possible embodiments, not shown in the drawings, back-plate 30 can be u-shaped or otherwise, and connecting means 20 can be comprised of, for example, one rather than two legs rising from the back-plate, with a rigid forehead-engagement means 10 being attached on one side but free on the other. Still other embodiments are contemplated, all exhibiting the same inventive principle: utilization of backward pressure of the seat-occupant's back to prevent the seat-occupant's head from falling forward, by the means as claimed below.

There have been described in the foregoing, in full, clear, concise and exact terms, the best embodiments of the invention presently contemplated. It is however understood that various modifications and combinations may be made of these embodiments, and that the invention may be otherwise embodied, without departing from the spirit and essence of this invention-namely, resistance of forward-pressure of the resting forehead by transmitting this pressure via connecting means to a back-plate sandwiched between the seat-occupant's back and the seat-back-rest, thus preventing rotation of said back-plate by the weight of the seat-occupant's back against the back-plate and so against the partially reclined seat-back-rest, thus holding the head upright.

I claim:

1. A head-support for use in combination with a partially-reclining seat, to prevent the seat-occupant's head from falling forward, comprising:

a forehead-engagement means for positioning in such manner as to engage the forehead of the seat-occupant;

a connecting means extending from said forehead-engagement means;

a back-plate extending from said connecting means and engaging and sandwiched between the seat-occupant's back and the back-rest of the seat, said back-plate being pressed upon by both the back-rest and the seat-occupant's back, such that the head of the seat-occupant is restrained against falling forward, by the transmittal of forces from said forehead-engagement means through said connecting means to said back-plate.

2. A head-support as in claim 1, where said connecting means comprises left and right members, attached respectively to the left and right sides of the upper part of the back-plate, and where the whole sub-structure of back-plate and connecting means is so shaped as to engage the shoulders of the seat-occupant as right and left lateral-support means.

* * * * *